US005854189A

United States Patent [19]

Kruse et al.

[11] Patent Number: 5,854,189

[45] Date of Patent: Dec. 29, 1998

[54] PROCESS FOR THE PRODUCTION OF BREAK-RESISTANT, STORABLE MULTIFUNCTIONAL DETERGENT TABLETS

[76] Inventors: Hans Kruse, Am Hallenbad 44, 41352 Korschenbroich; Jochen Jacobs, Teschensudberg 50, 42349 Wuppertal; Peter Jeschke, Macherscheider Str. 137, 41468 Neuss, all of Germany

[21] Appl. No.: 716,220

[22] PCT Filed: Mar. 6, 1995

[86] PCT No.: PCT/EP95/00821

§ 371 Date: Sep. 13, 1996

§ 102(e) Date: Sep. 13, 1996

[87] PCT Pub. No.: WO95/25161

PCT Pub. Date: Sep. 21, 1995

[30] Foreign Application Priority Data

Mar. 15, 1994 [DE] Germany ..... 44 08 718.7

[51] Int. Cl.[6] ..... C11D 11/00

[52] U.S. Cl. ..... 510/224; 510/441; 510/446; 510/477; 510/478

[58] Field of Search ..... 510/224, 225, 510/227, 441, 446, 477, 478

[56] References Cited

U.S. PATENT DOCUMENTS

| | | | |
|---|---|---|---|
| 3,318,817 | 5/1967 | Smith | 510/441 |
| 4,219,436 | 8/1980 | Gromer et al. | 510/224 |
| 4,526,698 | 7/1985 | Kuroda et al. | 252/99 |
| 4,587,031 | 5/1986 | Kruse et al. | 510/224 |
| 4,839,078 | 6/1989 | Kruse et al. | 252/99 |
| 4,996,006 | 2/1991 | Constantine et al. | 510/446 |
| 5,205,955 | 4/1993 | Bunczk et al. | 510/192 |
| 5,382,377 | 1/1995 | Raehse et al. | 510/445 |

FOREIGN PATENT DOCUMENTS

| | | |
|---|---|---|
| 0737738 | 10/1996 | European Pat. Off. . |
| 31 04 371 | 11/1982 | Germany . |
| 33 21 082 | 12/1983 | Germany . |
| 35 41 145 | 5/1987 | Germany . |
| 39 37 469 | 5/1991 | Germany . |
| 41 21 307 | 1/1993 | Germany . |
| 42 28 786 | 3/1994 | Germany . |
| WO 94/23011 | 10/1994 | WIPO . |
| 96/23053 | 8/1996 | WIPO . |

*Primary Examiner*—Paul Lieberman
*Assistant Examiner*—Lorna M. Douyon
*Attorney, Agent, or Firm*—Ernest G. Szoke; Wayne C. Jaeschke; Real J. Grandmaison

[57] ABSTRACT

The process of producing break-resistant and storage-stable detergent tablets comprising coating powdered or crystalline detergent components present in anhydrous form or having a low degree of hydration with a hydrophobicizing agent, and tabletting the resulting mixture under pressure to produce tablets having a breaking strength of at least 150 N.

4 Claims, No Drawings

PROCESS FOR THE PRODUCTION OF BREAK-RESISTANT, STORABLE MULTIFUNCTIONAL DETERGENT TABLETS

BACKGROUND OF THE INVENTION

1. Field of the Invention

Machine dishwashing generally consists of a prerinse cycle, a main wash cycle, one or more intermediate rinse cycles, a clear rinse cycle and a drying cycle. This applies in principle both to domestic dishwashing machines and to institutional dishwashing machines.

2. Discussion of Related Art

Machine dishwashing detergents can be formulated as liquids, pastes, powders and tablets. Tablet-form machine dishwashing detergents are becoming increasingly more popular because they are easy to handle. Several production processes leading to tablets with controllable dissolving behavior have already been described. These tablets are often positioned in the machine itself rather than in the detergent dispensing compartment in the door which enables the tablets to be dissolved to a certain extent in the prerinse cycle so that the effect of the generally additive-free tap water is chemically supported even in this early phase. Thus, DE 35 41 145, for example, describes alkaline machine dishwashing detergent tablets of uniform composition which have a broad solubility profile and which contain a mixture of sodium metasilicate monohydrate and anhydrous metasilicate and also anhydrous pentasodium triphosphate and, optionally, other constituents. DE 41 21 307 describes stable, bifunctional, phosphate- and metasilicate-free low-alkali machine dishwashing detergent tablets of which the builder components are partly used in water-free form and, during the production process, are sprayed with water which guarantees the required solubility profile and provides for favorable tabletting behavior.

In all known cases, the mixture to be tabletted is produced either with components having a high water of crystallization content, which readily give off their water of crystallization during tabletting, or by addition of free water to water-free components to anhydrize their surfaces. The resulting slight moisture content facilitates agglomeration and ensures good tabletting behavior.

However, since the water in the known tablets is present in completely or partly free form, the incorporation of water-sensitive or rather moisture-sensitive components was possible to only a limited extent, if at all. These components include inter alia bleaching systems based on per compounds and bleach activators, enzymes or even certain corrosion inhibitors.

Accordingly, the problem addressed by the present invention was to provide a process which would not only lead to break-resistant and storable, multifunctional tablets, but—in particular—would also enable water-sensitive or moisture-sensitive components of known detergent tablets to be incorporated and would avoid any deterioration therein during production and storage.

DESCRIPTION OF THE INVENTION

It has now been found that break-resistant and storable, multifunctional detergent tablets can be obtained providing the production process is carried out without the addition of free water and without the use of compounds which readily eliminate water of hydration and providing the powder-form or crystalline components of the detergent mixture are hydrophobicized individually and/or as mutually compatible powder-form or optionally granulated mixtures, are optionally mixed together again, other hydrophobicized or even non-hydrophobicized constituents are added and the resulting mixture is tabletted.

Accordingly, the present invention relates to break-resistant and storable, multifunctional detergent tablets of any composition, the powder-form or crystalline components used in water-free form or with a low degree of hydration being coated with a hydrophobicizing compound either individually or in the form of mutually compatible powder-form or optionally granulated mixtures. In addition, the powder-form or crystalline components may contain other moisture-sensitive components, optionally with their own hydrophobicizing coating.

The detergent tablets according to the present invention may have a high degree of alkalinity with pH values above 11 or a low degree of alkalinity with pH values below 11. Accordingly, they may contain in known manner pentaalkali metal triphosphates, alkali metal silicates, alkali metal carbonates, bleaching agents, optionally bleach activators and alkali metal hydroxides, zeolites and/or enzymes. Individual components or mixtures thereof may again be hydrophobicized. However, they may be phosphate- and silicate-free with a low degree of alkalinity and, instead of compounds eliminating active chlorine, may contain oxygen-yielding compounds as bleaching agents and activators therefor and also enzymes. In both cases, they may also contain low-foaming nonionic surfactants.

In a preferred embodiment, the present invention relates to break-resistant and storable, phosphate-free and preferably alkali-metal-silicate-free, low-alkali multifunctional detergent tablets, more particularly for machine dishwashing, based on builders, nonionic surfactants, enzymes, bleaching agents and bleach activators, characterized in that the powder-form or crystalline components are coated with the same or different hydrophobicizing compounds either individually or the form of mutually compatible, powder-form or optionally granulated mixtures, the hydrophobicizing compounds as such optionally containing liquid or even powder-form tablet components.

The hydrophobicizing compounds are applied to the powder-form or crystalline components or mixtures thereof in liquid or liquefied form through a nozzle controllable in known manner, a thin protective coating being formed on the solids and being more uniform and stable, the more finely the liquid droplets are dispersed after leaving the nozzle. The hydrophobicizing substance is present in liquid form during the hydrophobicizing process. It may be a liquid, for example an oil, under normal conditions or may even be a solid, for example wax, which is applied in molten form in the hydrophobicizing stage. The melting range of the hydrophobicizing substance must always be below the desired in-use temperature. Any solubility variants of the individual constituents or mixtures thereof can be determined in advance through the choice of hydrophobicizing substances with different boiling or melting ranges, which can also be varied through the liquid or powder-form tablet constituents optionally incorporated therein, so that their required dissolution in use can be controlled as a function of the temperature and the time of a machine dishwashing process. Since some of these hydrophobicizing substances are also known as tabletting aids, the tabletting process can be carried out particularly reliably in this way as a side effect. The coating of hydrophobicizing substances enables incompatible substances not only to be thoroughly mixed with one another in a simple manner, but also to be converted into storage-stable tablets.

The builder used may be substantially water-free trisodium citrate or, preferably, dihydrated trisodium citrate. The dihydrated trisodium citrate may be used in the form of a fine or coarse powder. The trisodium citrate content is between about 20 and 80% by weight and preferably between about 30 and 60% by weight and may be completely or partly replaced, i.e. to a level of about 80 and preferably about 50% of its weight, by naturally occurring hydroxycarboxylic acids such as, for example, monohydroxysuccinic acid, dihydroxysuccinic acid, α-hydroxypropionic acid and gluconic acid.

The tablets according to the invention may also contain alkali metal carbonates, alkali metal hydrogen carbonates, alkali metal sulfates or polycarboxylates as additional builders and/or fillers. The polycarboxylates, for example Sokalan® CP 5 (BASF), or even completely biodegradable polymers, such as oxidized starches or even dextrin, may also serve as additional tabletting aids.

If the detergents are to remain warning-free after packaging, it is important to keep the EU formulation guidelines for detergents and cleaners. Accordingly, the quantity of preferably compact alkali metal carbonates which may be used is between about 0 and about 15% by weight and preferably between about 2 and 12% by weight. If naturally occurring $Na_2CO_3xNaHCO_3$ (Trona, a Solvay product) is used, the quantity in which it is used may have to be doubled. To inhibit corrosion of the machine loads, particularly in the case of aluminium, decorative glazes and glasses, sodium disilicate ($Na_2O:SiO_2$=1:2) is best incorporated in the tablets. The quantities used need only be small, for example from 0 to about 5% by weight and preferably from 0 to about 2% by weight.

The alkali metal hydrogen carbonate is preferably sodium bicarbonate. The sodium bicarbonate should preferably be used in coarse compacted form with a particle size in the main fraction of from about 0.4 to 1.0 mm. Its percentage content in the detergent forms the difference between the sum total of the other components and 100% by weight of the detergent as a whole.

Although there is no need for native or preferably synthetic polymers, they may still be added to detergents intended for use in hard water areas in quantities of up to at most about 20% by weight and preferably in quantities of 0 to 10% by weight. The native polymers include, for example, oxidized starch (for example DE 42 28 786) and polyamino acids, such as polyglutamic acid or polyaspartic acid, for example of the type obtainable from Cygnus and SRCHEM. The synthetic poly(meth)acrylates may be used in powder form or in the form of a 40% aqueous solution, although they are preferably used in granulated form. Suitable polyacrylates include Alcosperse® types 102, 104, 106, 404, 406 (products of Alco); Acrylsol® types A 1N, LMW 45N, LMW 10N, LMW 20N, SP 02N (products of Norsohaas); Norasol® types WL1, WL2, WL3, WL4; Degapas® (Degussa AG); Good-Rite® K-XP 18 (Goodrich). Copolymers of polyacrylic acid and maleic acid (poly(meth) acrylates) may also be used, for example Sokalan® types CP 5 and CP 7 (BASF AG); Acrysol® QR 1014 (Norsohaas); Alcosperse® 175 (Alco); the granular alkaline detergent additive according to DE 39 37 469.

Extremely low-foaming compounds in quantities of 0.1 to about 5% by weight and preferably in quantities of about 0.2 to 4% by weight are used as nonionic surfactants which improve the removal of fat-containing food remains and which also act as wetting agents and even as tabletting aids. Preferred nonionic surfactants are $C_{12-18}$ alkyl polyethylene glycol polypropylene glycol ethers containing up to 8 moles of ethylene oxide units and up to 8 moles of propylene oxide units in the molecule. However, it is also possible to use other nonionic surfactants known for their low-foaming behavior, including for example $C_{12-18}$ alkyl polyethylene glycol polybutylene glycol ethers containing up to 8 moles of ethylene oxide units and up to 8 moles of butylene oxide units in the molecule, end-capped alkyl polyalkylene glycol mixed ethers and the foaming, but ecologically attractive $C_{8-10}$ alkyl polyglucosides and/or $C_{12-14}$ alkyl polyethylene glycols containing 3 to 8 ethylene oxide units in the molecule with a degree of polymerization of about 1 to 4, together with 0 to about 1% by weight and preferably 0 to about 0.5% by weight, based on the final detergent, of defoamers, for example silicone oils, mixtures of silicone oil and hydrophobicized silica, paraffin oil/Guerbet alcohols, bis-stearic acid diamide, hydrophobicized silica and other known commercially available defoamers. $C_{8-10}$ alkyl polyglucoside with a degree of polymerization of about 1 to 4 is preferably used. A bleached quality should be used because otherwise brown granules are formed.

Enzymes are used to improve the removal of protein-, starch- and tallow-containing food remains. Examples of suitable enzymes are proteases, amylases, lipases and cellulases, for example proteases, such as BLAP® 140 (Henkel KGaA); Optimase® M-440, Optimase® M-330, Opticlean® M-375, Opticlean® M-250 (Solvay Enzymes); Maxacal® CX 450.000, Maxapem® (Ibis); Savinase® 4,0 T, 6,0 T, 8,0 T (Novo) or Experase® T (Ibis), and amylases, such as Termamyl® 60 T, 90 T (Novo); Amylase-LT® (Solvay Enzymes) or Maxamyl® P 5000, CXT 5000 or CXT 2900 (Ibis); lipases, such as Lipolase® 30 T (Novo); cellulases, such as Celluzym® 0,7 T (Novo Nordisk). The enzymes generally used in the form of a mixture make up around 0.5 to 5% by weight and preferably around 1 to 4% by weight of the detergent as a whole.

At present, active oxygen carriers are preferably used as bleaching agents. Active oxygen carriers include, above all, sodium perborate monohydrate and tetrahydrate and also sodium percarbonate. However, the use of sodium percarbonate stabilized, for example, with boron compounds (DE-A-33 21 082) also has advantages because it has a particularly favorable effect on the corrosion behavior of glasses. Since active oxygen only develops it full effect on its own at elevated temperature, so-called bleach activators are added at around 60° C., the approximate temperatures of the domestic machine dishwashing process, for the purposes of activation. Preferred bleach activators are TAED (tetraacetyl ethylenediamine), PAG (pentaacetyl glucose), DADHT (1,5-diacetyl-2,2-dioxohexahydro-1,3,5-triazine) and ISA (isatoic anhydride). In addition, it can also be useful to add small quantities of known bleach stabilizers, for example alkali metal phosphonates, alkali metal borates or alkali metal metaborates and metasilicates. The bleaching agents make up about 1 to 20% by weight and preferably about 2 to 12% by weight of the detergent as a whole while the bleach activator makes up about 1 to 8% by weight and preferably about 2 to 4% by weight.

Suitable hydrophobicizing substances are paraffin oils and solid paraffins with melting ranges of 30° to 60° C. and preferably 35° to 45° C. Paraffins with melting ranges of 42° to 44° C. are preferably used.

Finally, other typical components may be added to the dishwashing detergents, including for example dyes and fragrances and also corrosion inhibitors for noble metals, particularly silver.

Examples of suitable corrosion inhibitors for noble metals are inorganic or organic redox-active substances, including metal salts and/or metal complexes from the group of manganese, titanium, zirconium, hafnium, vanadium, cobalt and cerium salts and/or complexes, the metals being present in one of the oxidation stages II, III, IV, V or VI (PCT 94/01386), and ascorbic acid, N-mono-($C_{1-4}$ alkyl)-glycine or N,N-di-($C_{1-4}$alkyl)-glucine, secondary intermediates and/or primary intermediates, such as diaminopyridines, aminohydroxypyridines, dihydroxypyridines, heterocyclic hydrazones, tetraaminopyrimidines, triaminohydroxypyrimidines, diaminodihydroxypyrimidines, dihydroxynaphthalenes, naphthols, pyrazolones, hydroxyquinolines, aminoquinolines, primary aromatic amines containing another free or $C_{1-4}$ alkyl- or $C_{2-4}$-hydroxyalkyl-substituted hydroxy or amino group in the ortho, meta or para position, and dihydroxy or trihydroxy benzenes, more especially p-hydroxyphenyl glycine, 2,4-diaminophenol, 5-chloro-2,3-pyridine diol, 1-(p-aminophenyl)-morpholine, hydroquinone, pyrocatechol, hydroxyhydroquinone, gallic acid, phloroglucinol and pyrogallol (PCT 94/01387).

Accordingly, the composition of the detergents according to the invention may lie within the following limits:

Na citrate dihydrate: 20 to 80% by weight, preferably 30 to 60% by weight

Na carbonate: 0 to 50% by weight, preferably 1 to 35% by weight

Na disilicate: 0 to 50% by weight, preferably 1 to 35% by weight

Polycarboxylate: 0 to 20% by weight, preferably 0 to 10% by weight

Nonionic surfactants: 0.1 to 5% by weight, preferably 0.2 to 4% by weight

Enzymes, total: 0.5 to 10% by weight, preferably 0.5 to 7% by weight

Silver protector: 0.05 to 5% by weight, preferably 0.05 to 3% by weight

Paraffin: 0.5 to 10% by weight, preferably 1 to 5% by weight

Active oxygen compounds: 1 to 20% by weight, preferably 2 to 12% by weight

Bleach activators: 0 to 8% by weight, preferably 0 to 4% by weight

Na hydrogen carbonate: rest pH value of a 1% aqueous solution: 8.5 to 11.5, preferably 9.0 to 11.0.

In addition, the present invention relates to a process for the production of break-resistant and storable, multifunctional detergent tablets, characterized in that the powder-form and/or crystalline components free from free water and salts of high hydrate content are coated either on their own or together with other readily soluble powder-form or optionally granulated inorganic components by spraying on a liquid or liquefied hydrophobicizing compound which, in turn, may contain liquid or powder-form components, for example nonionic surfactants, fragrances or corrosion inhibitors, and the mixture is subsequently mixed with other optionally hydrophobicized solid constituents and tabletted in standard tablet presses, optionally in the presence of other known tabletting aids, for example cellulose ethers, microcrystalline cellulose, starch and the like.

Citric acid or salts thereof is/are sprayed either on its/their own or in admixture with other readily soluble inorganic components, for example sodium carbonate and/or sodium hydrogen carbonate, with paraffin oil or paraffin wax having a boiling or melting range of around 20° to 60° C., although paraffins with other melting ranges may also be used. Nonionic surfactants or fine-particle solids, such as corrosion inhibitors, may be added to the hydrophobicizing liquid. Other solid constituents, such as active oxygen compounds and optionally hydrophobicized bleach activators, may then be added, preferably after having been sprayed with the nonionic surfactants, so that the dissolution of the tablets is further delayed. The mixture obtained has a weight per liter of around 600 to 1000 g/l and is tabletted under a force of 60 kN in standard tablet presses to form tablets weighing around 25 g for a diameter of 38 mm and a density of 1.6 g/cm$^3$.

The tabletting process may be carried out in standard tablet presses, for example eccentric presses, hydraulic presses or even rotary presses. Tablets with a breaking strength of >150N and preferably >300N are obtained. The breaking strength is understood to be the force applied by a wedge which is required to destroy a tablet. It is based on the above-mentioned tablet weight of 25 g and tablet diameter of 38 mm.

Through the choice of the hydrophobicizing substance, including—preferably—paraffins with different melting points, it is possible to ensure that a certain amount of the tablet is actually dissolved in the prerinse cycle at tap water temperatures and acts on the soiled dishes, the rest of the tablet only being dissolved and developing its effect at the temperatures prevailing in the main wash cycle. In addition, the oxidation-sensitive enzymes and oxygen-yielding compounds and their activators can even be dissolved separately from one another and thus successively activated by further variation of the melting ranges. Moisture-sensitive manganese sulfate, for example, may also be incorporated in the tablet as a silver protector. Stable or non-discoloring tablets are obtained by incorporating untreated manganese sulfate in the hydrophobicized compound, preferably in the form of a suspension in paraffin.

Finally, the present invention also relates to the use of the tablets produced in accordance with the invention by introduction thereof into the dishwashing machine at a place favorably situated from the point of view of flow, preferably in the cutlery basket or in a separate special container, which may even be sold together with the tablet (or tablets), so that the tablets are exposed to the prerinse cycle.

EXAMPLES

The following basic composition was used:

| | |
|---|---|
| Sokalan ® blend (50% CP5) | 20.0% by weight |
| Sodium carbonate, anhydrous | 5.7% by weight |
| Sodium hydrogen carbonate, anhydrous | 30.0% by weight |
| Trisodium citrate dihydrate | 30.0% by weight |
| Perborate monohydrate | 5.0% by weight |
| TAED granules | 2.0% by weight |
| Enzymes | 2.5% by weight |
| Plurafac ® 403 (BASF) | 0.9% by weight |
| Fragrance | 0.6% by weight |
| Paraffin and/or paraffin oil (Mp. 42–44° C.) | 3.0% by weight |
| Mn(II) sulfate | 0.3% by weight |

Plurafac® LF 403: Fatty alcohol ethoxylate with a cloud point of 41° C., a solidification point of <5° C. and a viscosity of 50 mPas at 23° C.

The tablets produced from this composition had a diameter of 38 mm, a density of 1.57 to 1.64 g/cm$^3$ and a tablet weight of 25 to 27 g.

Example 1

Before tabletting, a mixture of paraffin oil and perfume, in which Mn(II) sulfate sprayed with 78% of filler wax (Lunaflex® 902 E 36) had been suspended, was sprayed onto Na citrate powder through a one-component solid-cone nozzle with a 1.6 mm diameter bore under a pressure of 7 to 8 bar. The powder was then mixed with the remaining solids while Plurafac® LF 403 was sprayed on through the same nozzle under a pressure of 0.7 to 0.8 MPa. The mixture was tabletted to 38 mm diameter cylindrical tablets in an eccentric press under pressures of 60 to 70 KN.

Example 2

As Example 1, but using coarse crystalline Na citrate dihydrate.

Example 3

As Example 2, except that paraffin with a melting range of 40° to 42° C. was sprayed on instead of paraffin oil. To this end, the paraffin was heated to 80°–85° C. The spraying pressure was around 0.7–0.8 MPa.

Example 4

As Example 2, except that free powder-form Mn(II) sulfate was used.

Example 5

As Example 2, except that free powder-form Mn(II) sulfate was mixed with the Na citrate dihydrate and both components were hydrophobicized together.

Example 6

As Example 4, except that paraffin with a melting range of 44° to 46° C. was used.

Example 7

As Example 6, except that the Na hydrogen carbonate and the TAED granules were mixed and hydrophobicized together with the coarse crystalline Na citrate dihydrate.

Example 8

As Example 4, except that the TAED powder was hydrophobicized together with the coarse crystalline Na citrate dihydrate.

Example 9

As Example 7, except that the perborate monohydrate was replaced by percarbonate.

Polymer-free basic composition:

| | |
|---|---|
| Sodium carbonate, anhydrous | 10,0% by weight |
| Sodium hydrogen carbonate, anhydrous | 30.0% by weight |
| Trisodium citrate dihydrate | 45.0% by weight |
| Sodium percarbonate | 5.0% by weight |
| TAED granules | 2.0% by weight |
| Amylase | 1.0% by weight |
| Protease | 1.0% by weight |
| Lipase | 1.0% by weight |
| Plurafac ® LF 403 (BASF) | 1.0% by weight |
| Fragrance | 0.6% by weight |
| Paraffin (Mp. 42–44° C.) | 3.0% by weight |
| Manganese (II) sulfate | 0.4% by weight |

The tablets produced from this composition had a diameter of 38 mm, a density of 1.57 to 1.64 g/cm$^3$ and a weight of 25 to 27 g.

Example 10

The polymer-free basic composition was used. A 75° to 85° C. paraffin melt (melting range 42°–44° C.), in which the manganese(II) sulfate had been suspended, was sprayed onto a mixture of coarse crystalline trisodium citrate dihydrate, compacted soda and TAED through a circular mist nozzle (bore diameter 1.6 mm) under a pressure of 0.7 to 0.8 MPa. A mixture of surfactant and fragrance was sprayed onto and mixed with the remaining components. The mixture was tabletted in a rotary press under a pressure of 50 to 60 MPa.

Example 11

As Example 10, but using a compound of percarbonate and nonionic surfactant sprayed thereon.

After storage for 6 months, none of the tablets produced in accordance with the foregoing Examples showed any changes in performance, in break resistance or in dissolving behavior. The control of the quantities of tablet respectively dissolved in the prerinse cycle and in the main wash cycle through the choice of the hydrophobicizing agent is clearly apparent. Numerous variations are possible and fall within the scope of the invention.

Results of the Examples

| Examples | 1 | 2 | 3 | 4 | 5 | 6 | 7 | 8 | 9 | 10 | 11 |
|---|---|---|---|---|---|---|---|---|---|---|---|
| Tablet density g/cm$^3$ | 1.60 | 1.61 | 1.63 | 1.61 | 1.59 | 1.57 | 1.64 | 1.61 | 1.60 | 1.61 | 1.62 |
| Breaking strength/N | 273 | 440 | 456 | 312 | 297 | 415 | 336 | 379 | 387 | 370 | 397 |
| Proportion dissolved in the prerinse cycle % | 36,4 | 34 | 20.3 | 34.9 | 36.5 | 23.4 | 16 | 33.6 | 17.2 | 24.6 | 19.6 |

What is claimed is:

1. A water free process of producing break-resistant and storage-stable detergent tablets consisting of coating powdered detergent components selected from the group consisting of builders, bleaching agents, enzymes and 0.2 to 4%/wt of nonionic surfactants, each component present being in anhydrous form with 1 to 5% by weight of a hydrophobicizing agent selected from the group consisting of paraffin oils and solid paraffins having a melting point of from 30° C. to 60° C., based on the weight of said tablets; optionally adding nonionic surfactants or perfume oil to said hydrophobicizing agent before spraying; or applying said nonionic surfactants or perfume oil to the powdered detergent components before coating with said hydrophobicizing agent; and tabletting the resulting mixture under pressure to produce tablets having a breaking strength of at least 150N.

2. A process as in claim 1 wherein said detergent tablets have a low degree of alkalinity, are phosphate- and silicate-free and are suitable for machine dishwashing.

3. A process as in claim 1 wherein said builder is selected from the group consisting of citric acid, citric acid salts, alkali metal hydrogen carbonates, and acrylic acid/maleic acid copolymers.

4. A process as in claim 1 wherein said tablets have a high degree of alkalinity with pH values above 11.

* * * * *